US008468833B2

(12) United States Patent
Carroni et al.

(10) Patent No.: US 8,468,833 B2
(45) Date of Patent: Jun. 25, 2013

(54) BURNER ARRANGEMENT, AND USE OF SUCH A BURNER ARRANGEMENT

(75) Inventors: Richard Carroni, Niederrohrdorf (CH); Marcel Rieker, Niedergoesgen (CH); Adnan Eroglu, Untersiggenthal (CH); Heinz Schaer, Matten (St. Stephan) (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 12/876,310

(22) Filed: Sep. 7, 2010

(65) Prior Publication Data

US 2011/0079014 A1 Apr. 7, 2011

Related U.S. Application Data

(63) Continuation of application No. PCT/EP2009/051695, filed on Feb. 13, 2009.

(30) Foreign Application Priority Data

Mar. 7, 2008 (CH) ..... 00349/08

(51) Int. Cl.
*F23D 11/40* (2006.01)

(52) U.S. Cl.
USPC ..... 60/737; 60/738; 60/740; 60/748; 431/346; 431/354

(58) Field of Classification Search
USPC .... 431/2, 8, 187, 202, 346, 354, 355; 60/737, 60/738, 740, 748; 239/399
See application file for complete search history.

(56) References Cited

U.S. PATENT DOCUMENTS

| | | | | |
|---|---|---|---|---|
| 3,859,786 | A * | 1/1975 | Azelborn et al. | 60/737 |
| 4,292,801 | A | 10/1981 | Wilkes et al. | |
| 4,932,861 | A | 6/1990 | Keller et al. | |
| 5,454,220 | A | 10/1995 | Althaus et al. | |
| 5,588,826 | A | 12/1996 | Dobbeling et al. | |

(Continued)

FOREIGN PATENT DOCUMENTS

| | | | |
|---|---|---|---|
| DE | 44 46611 | A1 | 6/1996 |
| DE | 196 54 116 | A1 | 6/1998 |

(Continued)

OTHER PUBLICATIONS

Joos, F. et al., "Field Experience of the Sequential Combustion System for the ABB GT24/GT26 Gas Turbine Family", IGTI/ASME 98-GT-220, 1998 Stockholm.

(Continued)

*Primary Examiner* — William H Rodriguez
*Assistant Examiner* — Steven Sutherland
(74) *Attorney, Agent, or Firm* — Leydig, Voit & Mayer, Ltd.

(57) ABSTRACT

A burner arrangement includes a tubular mixing tube extending along an axis and configured to mix fuel and air, the mixing tube opening into a combustion chamber in a direction of flow; and a film air ring disposed in the mixing tube and arranged concentrically to the axis, the film air ring configured to prevent a backfiring of the fuel disposed in the mixing tube and to generate or reinforce an air film near the wall, wherein the film air ring has at least one annular gap concentric to the axis and configured to inject air.

17 Claims, 2 Drawing Sheets

U.S. PATENT DOCUMENTS

| | | | | | |
|---|---|---|---|---|---|
| 5,592,819 | A | | 1/1997 | Ansart et al. | |
| 5,609,030 | A | | 3/1997 | Althaus | |
| 5,626,017 | A | | 5/1997 | Sattelmayer | |
| 5,673,551 | A | | 10/1997 | Dobbeling | |
| 5,735,687 | A | | 4/1998 | Knoepfel et al. | |
| 5,778,676 | A | * | 7/1998 | Joshi et al. | 60/746 |
| 5,791,894 | A | | 8/1998 | Dobbeling et al. | |
| 5,832,732 | A | * | 11/1998 | Knopfel et al. | 60/760 |
| 5,921,770 | A | | 7/1999 | Sattelmayer | |
| 5,987,889 | A | * | 11/1999 | Graves et al. | 60/748 |
| 6,019,596 | A | | 2/2000 | Knoepfel et al. | |
| 6,045,351 | A | | 4/2000 | Doebbling et al. | |
| 6,059,565 | A | | 5/2000 | Knoepfel et al. | |
| 6,126,439 | A | | 10/2000 | Knoepfel et al. | |
| 6,152,726 | A | | 11/2000 | Ruck et al. | |
| 7,162,864 | B1 | | 1/2007 | Schefer et al. | |
| 7,491,056 | B2 | | 2/2009 | Knoepfel | |
| 7,871,262 | B2 | | 1/2011 | Carroni et al. | |
| 8,033,821 | B2 | | 10/2011 | Eroglu | |
| 2001/0034001 | A1 | | 10/2001 | Poe et al. | |
| 2002/0064738 | A1 | | 5/2002 | Hugens, Jr. | |
| 2004/0172949 | A1 | | 9/2004 | Stuttford | |
| 2004/0226299 | A1 | | 11/2004 | Drnevich | |
| 2007/0259296 | A1 | | 11/2007 | Knoepfel | |
| 2008/0000234 | A1 | | 1/2008 | Commaret et al. | |
| 2009/0044539 | A1 | | 2/2009 | Eroglu et al. | |

FOREIGN PATENT DOCUMENTS

| | | | |
|---|---|---|---|
| EP | 0 321 809 | A1 | 6/1989 |
| EP | 0 620 362 | A1 | 10/1994 |
| EP | 0 671 590 | A | 9/1995 |
| EP | 0 694 740 | A | 1/1996 |
| EP | 0 704 657 | A1 | 4/1996 |
| EP | 0 777 081 | A1 | 6/1997 |
| EP | 0 833 105 | A | 4/1998 |
| EP | 0 913 630 | A1 | 5/1999 |
| EP | 0 918 190 | A | 5/1999 |
| EP | 0 994 300 | A | 4/2000 |
| EP | 1 873 455 | A | 1/2008 |
| JP | 9184606 | A | 7/1997 |
| JP | 2002181330 | A | 6/2002 |
| WO | WO 2006/048405 | A1 | 5/2006 |
| WO | WO 2006/058843 | A | 6/2006 |
| WO | WO 2006/069861 | A1 | 7/2006 |
| WO | WO 2007/113074 | A1 | 10/2007 |

OTHER PUBLICATIONS

Mukherjee, "State-of-the-art gas turbines—a brief update" ABB Review Feb. 1997 (pp. 4-14) Switzerland.

International Search Report from corresponding PCT Application No. PCT/EP2009/051764 dated Jul. 14, 2009.

International Search Report from corresponding PCT Application No. PCT/EP2009/051695 dated Jul. 14, 2009.

* cited by examiner

BURNER ARRANGEMENT, AND USE OF SUCH A BURNER ARRANGEMENT

CROSS REFERENCE TO PRIOR APPLICATIONS

This application is a continuation application of International Patent Application No. PCT/EP2009/051695, filed Feb. 13, 2009, which claims priority to Swiss Patent Application No. CH 00349/08, filed Mar. 7, 2008. The entire disclosure of both applications is incorporated by reference herein.

FIELD

The present invention relates to the area of combustion technology.

BACKGROUND

AEV-type premix burners (AEV=Advanced Environmental Vortex) are used in stationary gas turbine plants. A premix burner of this kind is disclosed by EP-0 704 657 A2, and said publication forms an integral part of the present application. The same applies to the additional developments of this premix burner for which applications have been made since then, e.g. EP-0 913 630 A1, U.S. Pat. No. 6,045,351, WO-A1-2006/048405. To aid comprehension, the explanation of the situation with reference to FIG. 1 of the present application will be kept such that the reference signs are also included. The premix burner 11 shown in FIG. 1 is fitted at the head end with a swirl generator and, on the downstream side, comprises a mixing tube 13 which, for its part, opens into a combustion chamber 14. This burner arrangement 10 extends along an axis 15. The air/fuel mixture 12 produced in the premix burner 11 is injected tangentially between the conical component shells, leading to the formation of a swirling flow which then undergoes complete mixing in the downstream mixing tube 13 with the fuel F introduced. Passing the fuel 25 exclusively to the swirl generator is not the only possibility: if required, a partial quantity 25' of the fuel F is introduced into the mixing tube 13.

An additional component of this burner arrangement 10 is a film air ring 16 arranged in the mixing tube 13 (indicated by the dashed box in FIG. 1), the purpose of which is to energize the flow layers near to the wall in the mixing tube to such an extent that the fuel located in this region or adhering there cannot cause backfiring.

As can be seen from the abovementioned publication (see FIG. 1 of that document), two annular rows of holes are arranged axially in series in the known film air ring, said holes meeting certain requirements in terms of their number, diameter and spatial orientation. By means of these rows of holes, a predetermined air throughput is achieved, amounting approximately to 1% of the total air throughput of the burner.

If fuels other than natural gas are burned in such a burner arrangement, the fuel is often trapped close to the wall of the mixing tube 13 in zones of low flow velocity. This then causes backfiring into the premix burner 11:

- In the case of dry oil: high-pressure combustion tests under certain operating conditions have shown that oil strikes the walls of the mixing tube.
- In the case of H2-rich fuels: LIF tests and combustion tests at 1 atm have confirmed that the comparatively low density of these fuels (especially as they are at relatively high temperatures, typically 150-350° C.) means a low penetration depth and a high risk that the fuel will readhere to the walls of the mixing tube.

Experience in the development of burners for dry oil and H2-rich fuels has indicated that it might be useful to increase the film air quantity in order to further energize the boundary layers near to the wall (i.e. to increase the local flow velocities) and thus avoid the risk of backfiring. Another factor contributing to this result is that the fuel concentration near to the wall is minimized. Normally, this could be achieved by increasing the cross section of the holes in the film air ring 16 (i.e. by boring the holes to a larger diameter). However, this leads to more powerful air jets, which penetrate the main flow in the mixing tube and no longer generate a film near to the wall. This is counterproductive for two reasons:

- The boundary layer near to the wall is no longer energized, and the lower local velocities that result therefore promote the occurrence of backfiring.
- The more powerful air jets penetrate the main flow and generate severe turbulence and a turbulent wake. Fuel caught in these vortices has a greatly prolonged dwell time in the mixing tube owing to the low local velocities there, and is correspondingly easy to ignite and can thus lead to backfiring.

SUMMARY OF THE INVENTION

In an aspect of the present invention a burner arrangement is provided with a mixing device which avoids the disadvantages of known burner arrangements and, in particular, reliably and in a simple manner prevents backfiring when highly reactive fuels, preferably H2-rich fuels, are used.

In an embodiment of the invention a film air ring is arranged in the mixing device, for generating or reinforcing an air film near to the wall, which is distinguished by the fact that it has at least one annular gap concentric with the axis for injecting air. The use of an annular gap produces a wide, flat air jet which has a shallower penetration depth into the main flow than the round air jets produced by holes and more easily hugs the walls of the mixing tube.

One embodiment of the invention is characterized in that a plurality of concentric annular gaps is arranged in series in the direction of the axis. This makes it possible to increase the flow rate of the air injected without an increase in penetration depth. In one variant embodiment, the annular gaps are uniformly spaced with respect to one another in the axial direction and all have the same gap width (slot width), although this is not to be taken as compulsory since the distance between the slots does not have to be constant. Within a burner, the slot widths can be of variable configuration in order to bring about locally a desired film air layer.

The effect of the injected air on the boundary layers in the mixing device is further enhanced by the fact that, according to another embodiment of the invention, the annular gaps are designed to slope in the direction of flow.

The structure is particularly simple if the film air ring is constructed from a plurality of ring elements which are arranged in series in the axial direction and, to form the annular gaps, are held apart by means of support elements arranged in a manner distributed around the circumference.

Another embodiment of the invention is characterized in that second means for generating a tangential component in the air flow emerging through the annular gaps into the mixing device are provided in the annular gap or annular gaps, the second means preferably comprising obliquely extending grooves in the walls bounding the annular gaps. This is a simple way of enabling a swirl to be imparted to the injected air, this swirl having an advantageous effect on the control of the boundary layers of the flow.

The mixing device is preferably designed as a cylindrical mixing tube, and the burner arrangement comprises a premix burner, in particular in the form of a double cone burner, the mixing tube being arranged at the outlet of the premix burner.

As regards the configuration of the premix burner, it is also quite possible to provide a premix burner without the transitional section acting between the swirl generator and the mixing tube. A premix burner of this kind is disclosed by EP-A1-0 321 809. Accordingly, the disclosure of this publication and the following further developments of this burner technology as regards the construction of the swirl generator explicitly form an integral part of the present application.

A further embodiment of a premix burner envisages providing transitional ducts between the swirl generator and the mixing tube to enable a swirling flow which forms in the swirl generator to be transferred into the flow cross section of the mixing tube downstream of said transitional ducts. An embodiment of this kind is disclosed by EP-0 704 657 A1, and the disclosure of this publication likewise forms an integral part of the present application.

A further embodiment of the premix burner envisages providing a cylindrical tube consisting of component shells, into which the combustion air flow flows into the interior space via tangentially arranged air inlet slots or ducts. As used herein, cylindrical means virtually cylindrical. The desired swirl formation in the combustion air flow to maximize the intended premixing with at least one fuel injected at an appropriate point is achieved or assisted by means of an internal body extending conically in the direction of flow. As used herein conical means virtually conical. An embodiment of this kind is disclosed by EP-0 777 081 A1, for example, and the disclosure of this publication forms an integral part of the present application.

The burner arrangement according to the invention is advantageously used for the operation of a gas turbine plant with at least one combustion chamber.

The burner arrangement according to the invention can be used to particular advantage in a gas turbine, especially one operated with highly reactive fuels.

Illustrative embodiments of the invention will be explained in greater detail below with reference to the drawings. All features that are not essential for directly understanding the invention have been omitted. In the various figures, identical elements have been provided with the same reference signs. The direction of flow of the various fluids is indicated by arrows.

BRIEF DESCRIPTION OF THE DRAWINGS

The invention will be explained in greater detail below by means of illustrative embodiments in conjunction with the drawing. In the drawing.

DETAILED DESCRIPTION

Figure 1:
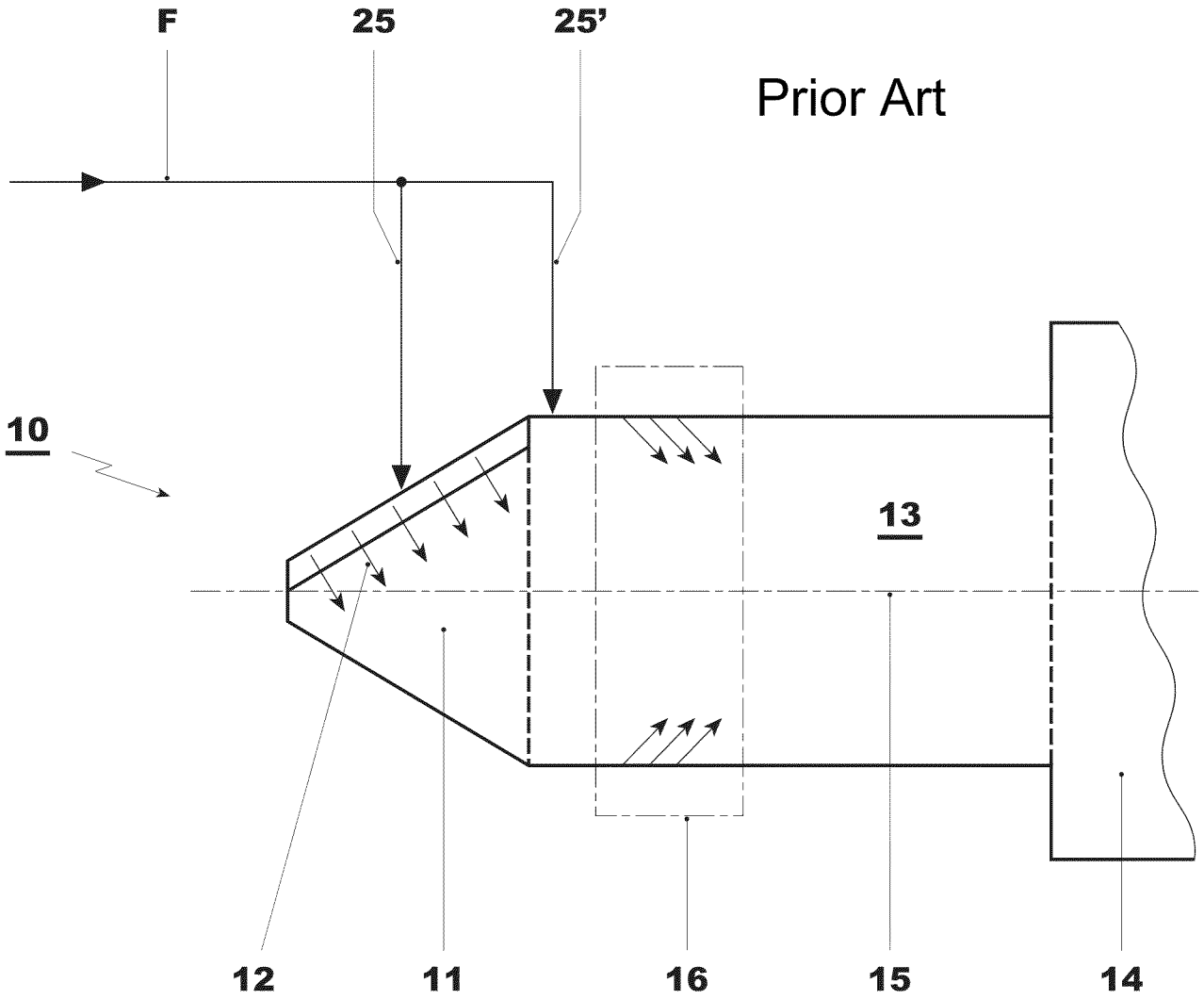
FIG. 1 shows a known burner arrangement with a premix burner and a downstream mixing tube, which has a film air ring, in a highly simplified representation.
Figure 2:
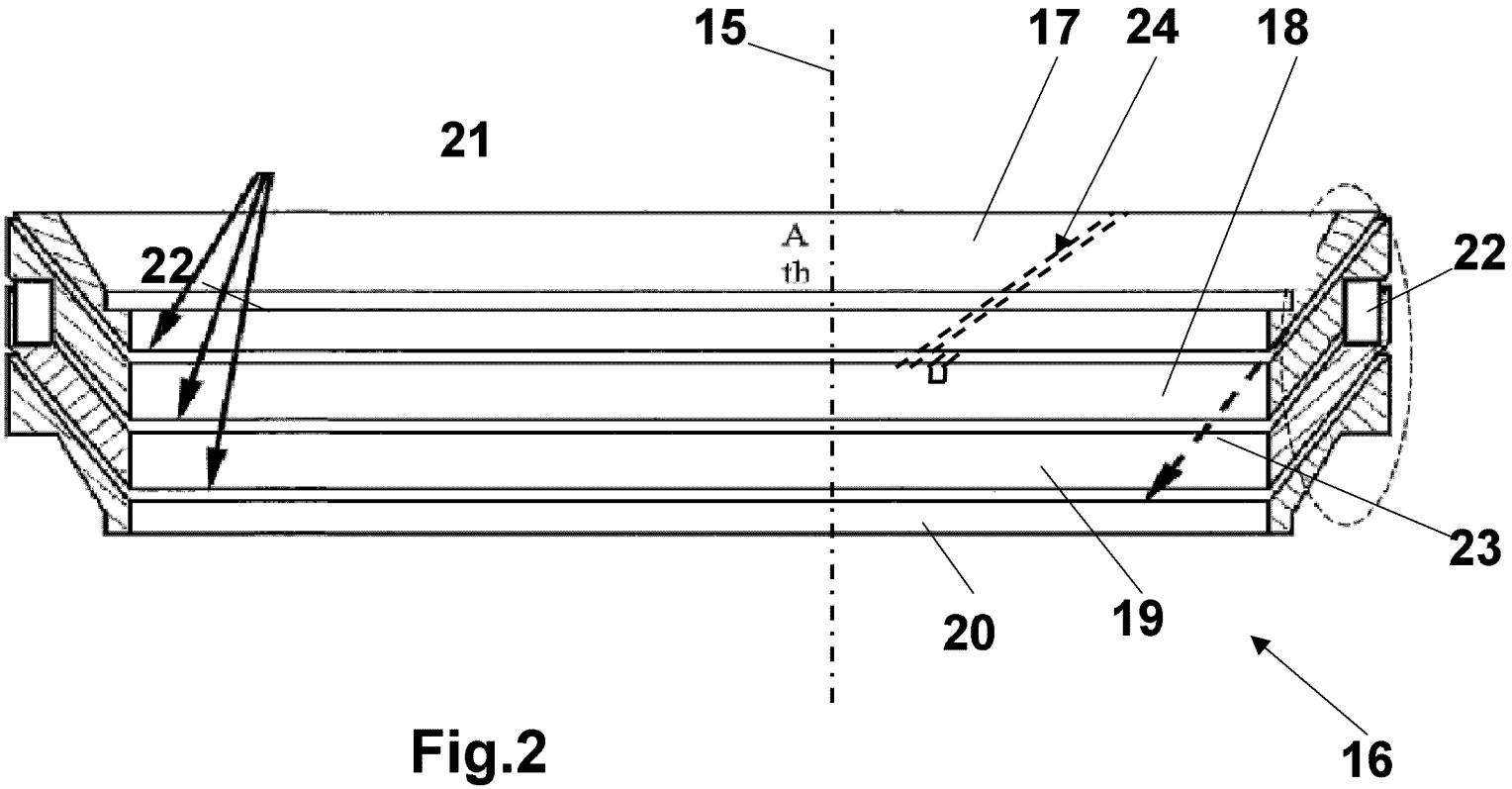
FIG. 2 shows the structure of a film air ring in accordance with a preferred illustrative embodiment of the invention, operating with annular gaps.

FIG. 2 shows a preferred illustrative embodiment of the newly proposed structure of a film air ring 16 for a burner arrangement 10 in accordance with FIG. 1. The new design is intended to generate a larger and more powerful film air layer near to the walls of the mixing tube 13. With the knowledge that flat jets have a shallower penetration depth than round jets—in fact flat jets tend to adhere more quickly to the walls in a cross flow—the rows of holes known from WO-A1-2006/048405 have been replaced in the mixing tube 13 in accordance with FIG. 2 by one or more annular gaps 21, which are arranged concentrically with the axis 15. As used herein concentric means virtually concentric. Air in the form of annular jets (23) is injected into the interior of the mixing tube 13 through the annular gaps 21, with the air jets 23 making relatively light contact with the wall of the mixing tube.

The overall cross section, the number of gaps 21, the gap width and also the spacing between the individual gaps can be changed easily in order to modify the flow rate of the injected air. It is a particularly simple matter to change the gap width. Moreover, the gaps 21 can be tilted by a selectable angle in the direction of flow in order to obtain a further improvement in the contact between the air jets 23 and the wall of the mixing tube 13.

It is also possible to impress upon the annular air jets 23 a tangential component (swirl) by introducing grooves 24 formed with an appropriate obliquity into the walls of the gaps 21 (in FIG. 2, just one groove 24 has been drawn by way of example).

In the illustrative embodiment in FIG. 2, three gaps 21 with the same gap width are provided in series at uniform intervals. The gaps 21 are formed by four ring elements 17, 18, 19 and 20 arranged axially in series at intervals corresponding to the gap width. The adjoining surfaces of the ring elements 17, . . . , 20 are preferably configured and matched to one another in such a way that gaps 21 with a uniform gap width are obtained across the entire wall thickness. The individual ring elements 17, . . . , 20 are held apart by local support elements 22, which are arranged between adjacent ring elements in a manner distributed around the circumference. Other production methods are, of course, also possible.

Atmospheric combustion tests with such a burner arrangement have shown that it was possible to avoid backfiring completely over a wide operating range using the annular gaps (which inject 150% more air than the comparable holes), and this has also been confirmed by high-pressure tests.

The novel film air ring according to the invention can be used with any fuel. However, it is particularly advantageous for the more reactive fuels (e.g. oil or H2-rich fuels) of the type burnt in a stationary gas turbine plant. However, the technology is not restricted to AEV burners but can also be used successfully in the mixing devices of other burners.

LIST OF REFERENCE SIGNS

10 burner arrangement
11 premix burner
12 air/fuel mixture
13 mixing tube
14 combustion chamber
15 axis
16 film air ring
17, . . . , 20 ring element
21 annular gap
22 support element
23 air jet
24 groove
25 fuel injection
25' fuel injection
F fuel

What is claimed is:

1. A burner arrangement comprising:

a tubular mixing tube extending along an axis and configured to mix fuel and air, the mixing tube opening into a combustion chamber in a direction of flow; and a film air ring disposed in the mixing tube and arranged concentrically to the axis, the film air ring configured to prevent a backfiring of the fuel disposed in the mixing tube and to generate or reinforce an air film near the wall, wherein the film air ring includes:

a plurality of annular gaps concentric to the axis, disposed in series, and configured to inject air, and a plurality of ring elements disposed in series in the axial direction, each ring element extending circumferentially around the mixing tube, wherein a plurality of support elements are distributed around a circumference of the burner arrangement and configured to hold the plurality of ring elements apart.

2. The burner arrangement as recited in claim 1, wherein the plurality of annular gaps are uniformly spaced with respect to one another in the axial direction.

3. The burner arrangement as recited in claim 1, wherein the plurality of annular gaps are at least one of nonuniformly and variably spaced in the axial direction.

4. The burner arrangement as recited in claim 1, wherein the plurality of annular gaps each have a same gap width.

5. The burner arrangement as recited in claim wherein the plurality of annular gaps each have a different gap width.

6. The burner arrangement as recited in claim 1, wherein the plurality of annular gaps are designed to slope in the direction of flow.

7. The burner arrangement as recited in claim 1, further comprising an element disposed in the at least one annular gap and configured to generate a tangential component in air flow emerging through the at least one annular gap into the mixing tube.

8. The burner arrangement as recited in claim 1, further comprising a premix burner including a swirl generator having at least two hollow conical component shells nested one inside the other in the direction of flow and complementing one another to form a body with an interior space, wherein a cross section of the interior space increases in the direction of flow, wherein the at least two conical shells each have a wall and each have a longitudinal axis of symmetry running offset with respect to one another such that the walls of each shell are adjacent to each other and form a tangential air inlet slot extending longitudinally for an inflow of the air into the interior space.

9. The burner arrangement as recited in claim 1, further comprising a premix burner including a swirl generator having at least two hollow conical component shells nested one inside the other in the direction of flow and complementing one another to form a body with an interior space, wherein a cross section of the interior space is cylindrical in the direction of flow, and wherein the at least two hollow shells each have a wall and each have a longitudinal axis of symmetry running offset with respect to one another such that the walls of each shell are adjacent to each other and form a tangential air inlet slot extending longitudinally for an inflow of the air into the interior space, wherein the interior space includes an internal body having a cross section conical with respect to the direction of flow.

10. The burner arrangement as recited in claim 1, further comprising a central fuel nozzle configured to inject the fuel into the interior space.

11. The burner arrangement as recited in claim 8, wherein the fuel is injected at least one of via the tangential slot of the swirl generator and into the mixing tube.

12. The burner arrangement as recited in claim 9, wherein the fuel is injected at least one of via the tangential slot of the swirl generator and into the mixing tube.

13. The burner arrangement as recited in claim 8, further comprising a transitional zone disposed between the swirl generator and the mixing tube and a transitional, duct for a transfer of the air flowing in the swirl generator into a flow cross section of the mixing tube downstream of the transitional duct.

14. The burner arrangement as recited in claim 9, further comprising a transitional zone disposed between the swirl generator and the mixing tube and a transitional duct for a transfer of the air flowing in the swirl generator into a flow cross section of the mixing tube downstream of the transitional duct.

15. The burner arrangement as recited in claim 1, wherein the burner arrangement is disposed in a gas turbine plant fired by the combustion chamber.

16. The burner arrangement as recited in claim 1, wherein the burner arrangement is disposed in a sequentially tired gas turbine plant.

17. The burner arrangement as recited in claim 1, wherein the burner arrangement is disposed in a combined cycle plant.

* * * * *